US008876566B1

(12) United States Patent
Hilbert et al.

(10) Patent No.: US 8,876,566 B1
(45) Date of Patent: Nov. 4, 2014

(54) MARINE EXHAUST SYSTEM WITH IDLE RELIEF CHAMBER

(71) Applicant: Brunswick Corporation, Lake Forest, WI (US)

(72) Inventors: David J. Hilbert, Black Creek, WI (US); Mark J. Glodowski, De Pere, WI (US)

(73) Assignee: Brunswick Corporation, Lake Forest, IL (US)

( * ) Notice: Subject to any disclaimer, the term of this patent is extended or adjusted under 35 U.S.C. 154(b) by 98 days.

(21) Appl. No.: 13/678,165

(22) Filed: Nov. 15, 2012

(51) Int. Cl.
*B63H 21/00* (2006.01)
*B63H 21/32* (2006.01)
*F01N 13/00* (2010.01)

(52) U.S. Cl.
CPC ..... *B62H 21/32* (2013.01)
USPC ..... 440/89 R; 440/89 J

(58) Field of Classification Search
USPC ..... 440/89 A, 89 B, 89 C, 89 F, 89 G, 89 J, 440/89 R
See application file for complete search history.

(56) References Cited

U.S. PATENT DOCUMENTS

| | | | | | |
|---|---|---|---|---|---|
| 4,019,456 | A | * | 4/1977 | Harbert | 440/88 R |
| 4,036,162 | A | * | 7/1977 | Maier et al. | 440/56 |
| 4,100,994 | A | * | 7/1978 | Stuart | 181/261 |
| 4,184,566 | A | | 1/1980 | Baker et al. | |
| 4,187,678 | A | * | 2/1980 | Herenius | 60/321 |
| 4,600,395 | A | * | 7/1986 | Pichl | 440/61 R |
| 4,744,778 | A | * | 5/1988 | Porter | 440/89 R |
| 4,781,021 | A | | 11/1988 | Winberg | |
| 5,048,291 | A | | 9/1991 | Rodskier | |
| 6,299,496 | B1 | * | 10/2001 | Griffiths et al. | 440/89 R |
| 6,638,124 | B2 | | 10/2003 | Zoubul et al. | |
| 6,800,005 | B2 | | 10/2004 | Yokoya | |
| 7,354,324 | B1 | | 4/2008 | Jaszewski et al. | |
| 2009/0269999 | A1 | | 10/2009 | Schaub et al. | |

* cited by examiner

*Primary Examiner* — Stephen Avila
*Assistant Examiner* — Anthony Wiest
(74) *Attorney, Agent, or Firm* — Andrus Intellectual Property Law, LLP

(57) ABSTRACT

A marine drive and marine exhaust pipe include a main exhaust flow chamber and an auxiliary idle relief chamber. The auxiliary idle relief chamber vents exhaust above the surface of the body of water in which the vessel is operating.

13 Claims, 7 Drawing Sheets

MARINE EXHAUST SYSTEM WITH IDLE RELIEF CHAMBER

BACKGROUND AND SUMMARY

The invention relates to exhaust systems for marine drives having an inboard engine, including stem drives.

Marine drives with an inboard engine, including stem drives, are known, including an idle relief system for the exhaust mixed with cooling water and vented overboard.

The present disclosure arose during continuing development efforts in the above technology.

BRIEF DESCRIPTION OF THE DRAWINGS

Prior Art

Present Disclosure

Figure 4:
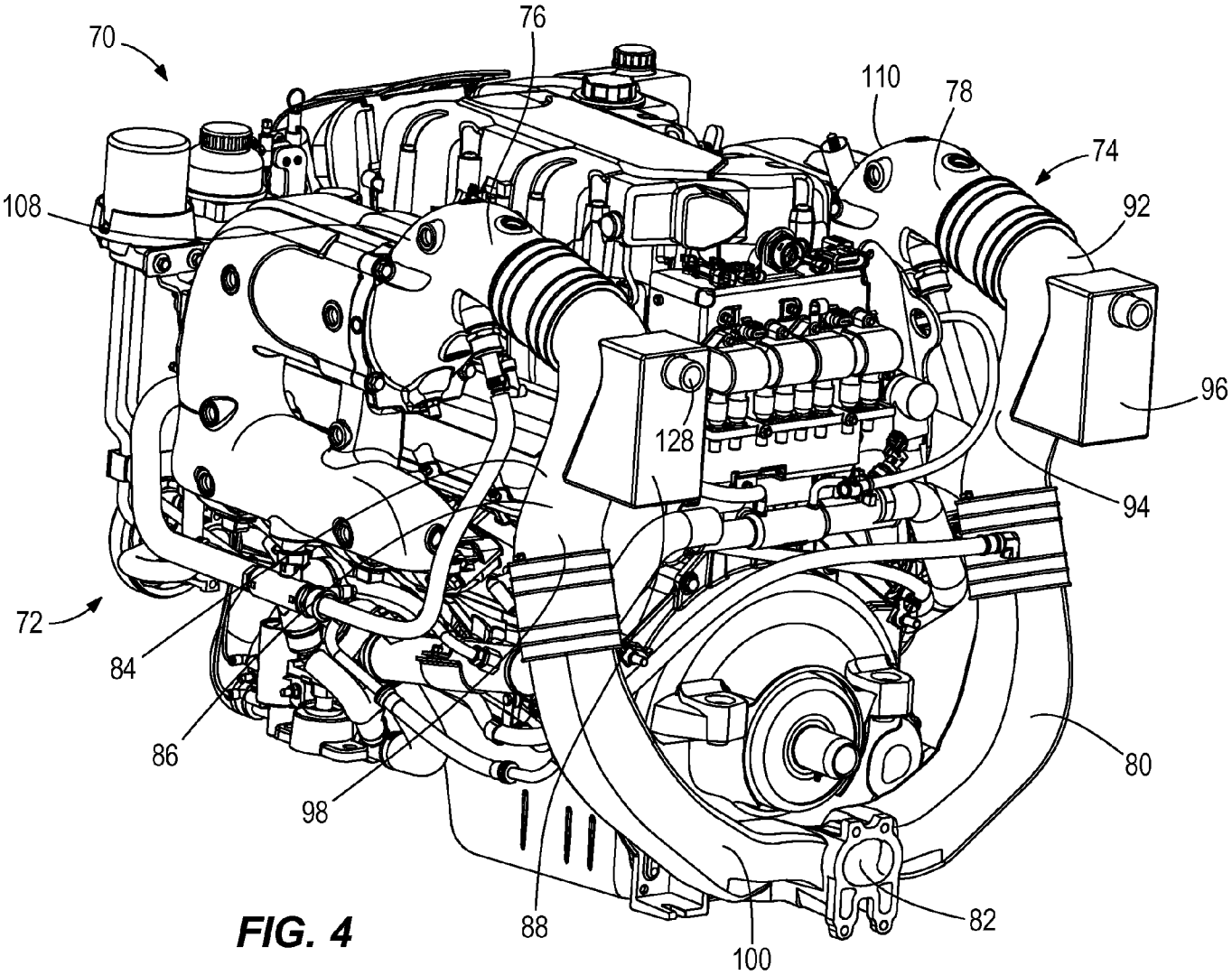

FIG. 4 is an isometric view of a portion of a marine drive including exhaust system in accordance with the present disclosure.

Figure 5:
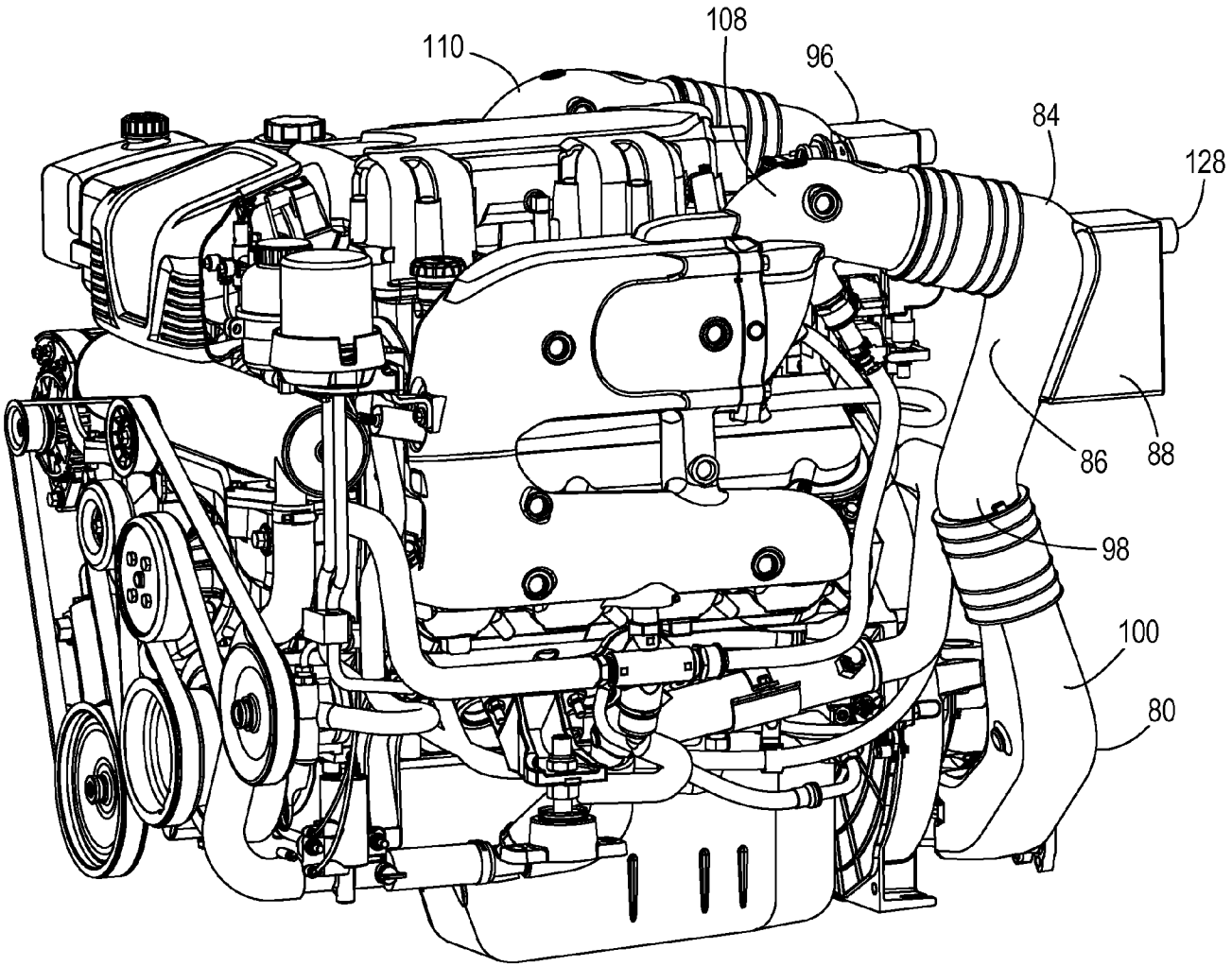

FIG. 5 is an isometric view of the assembly of FIG. 4 from a different angle.

Figure 6:
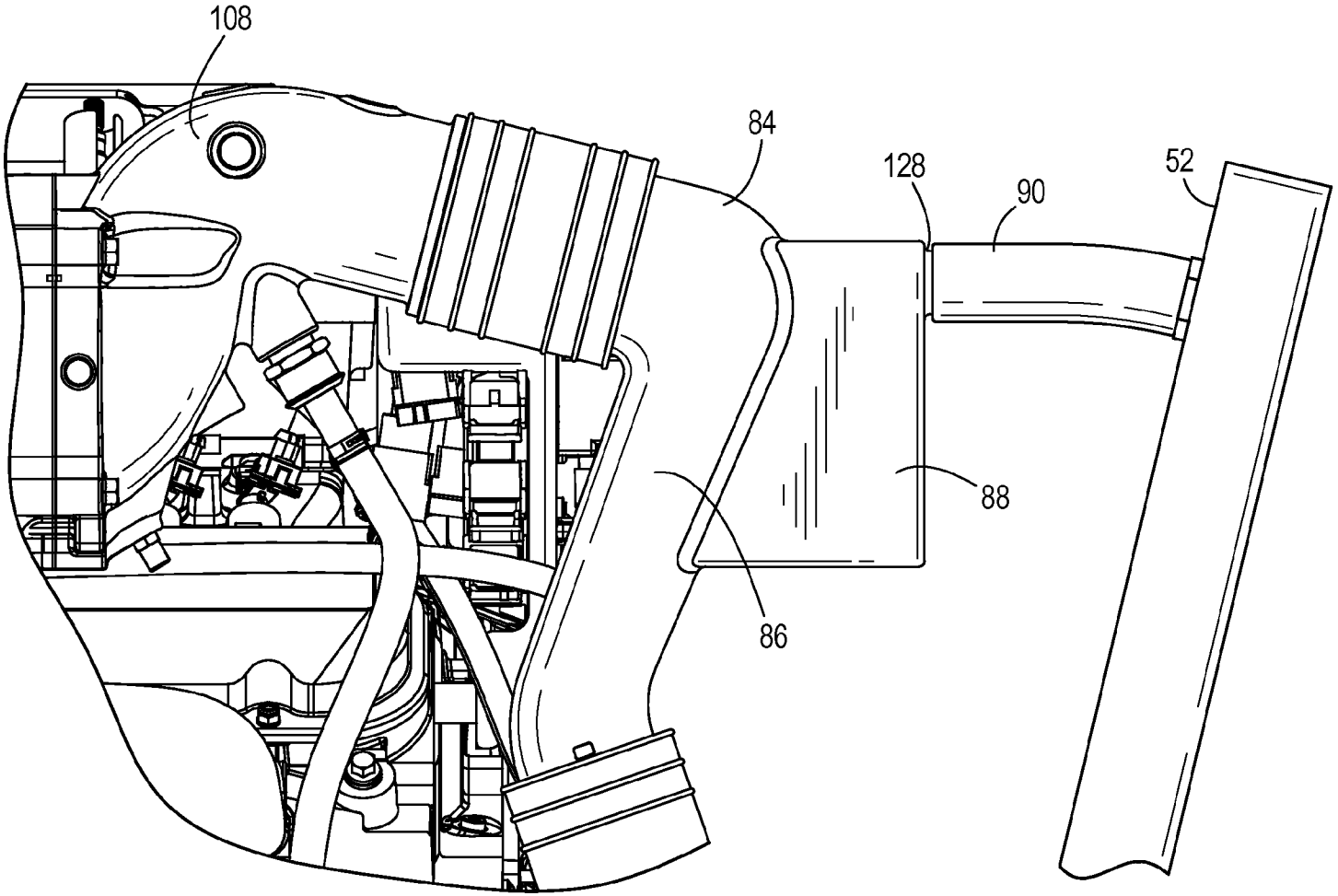

FIG. 6 is a side view of a portion of FIG. 5.

Figure 7:
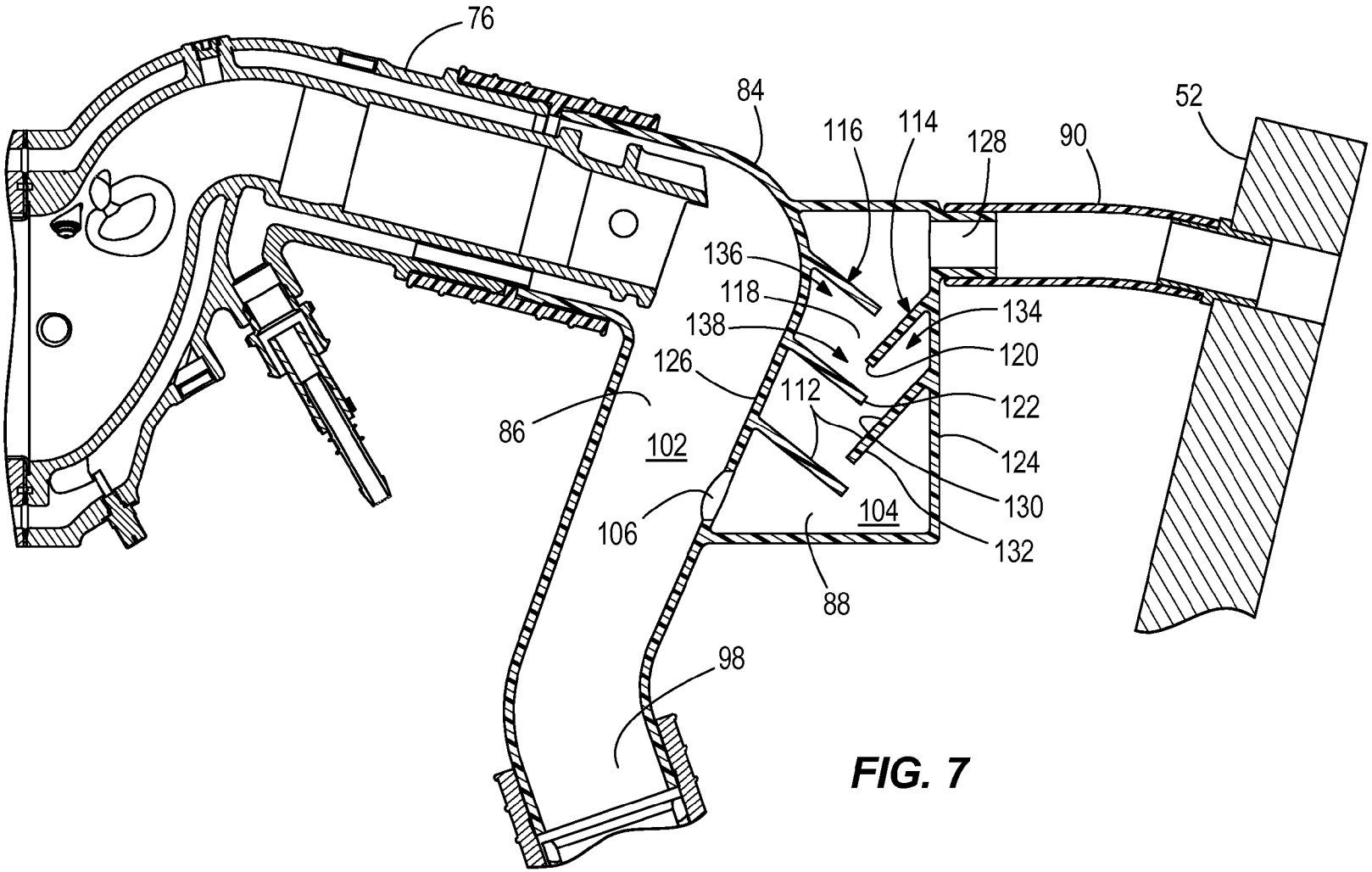

FIG. 7 is a sectional view of the assembly of FIG. 6.

Figure 8:
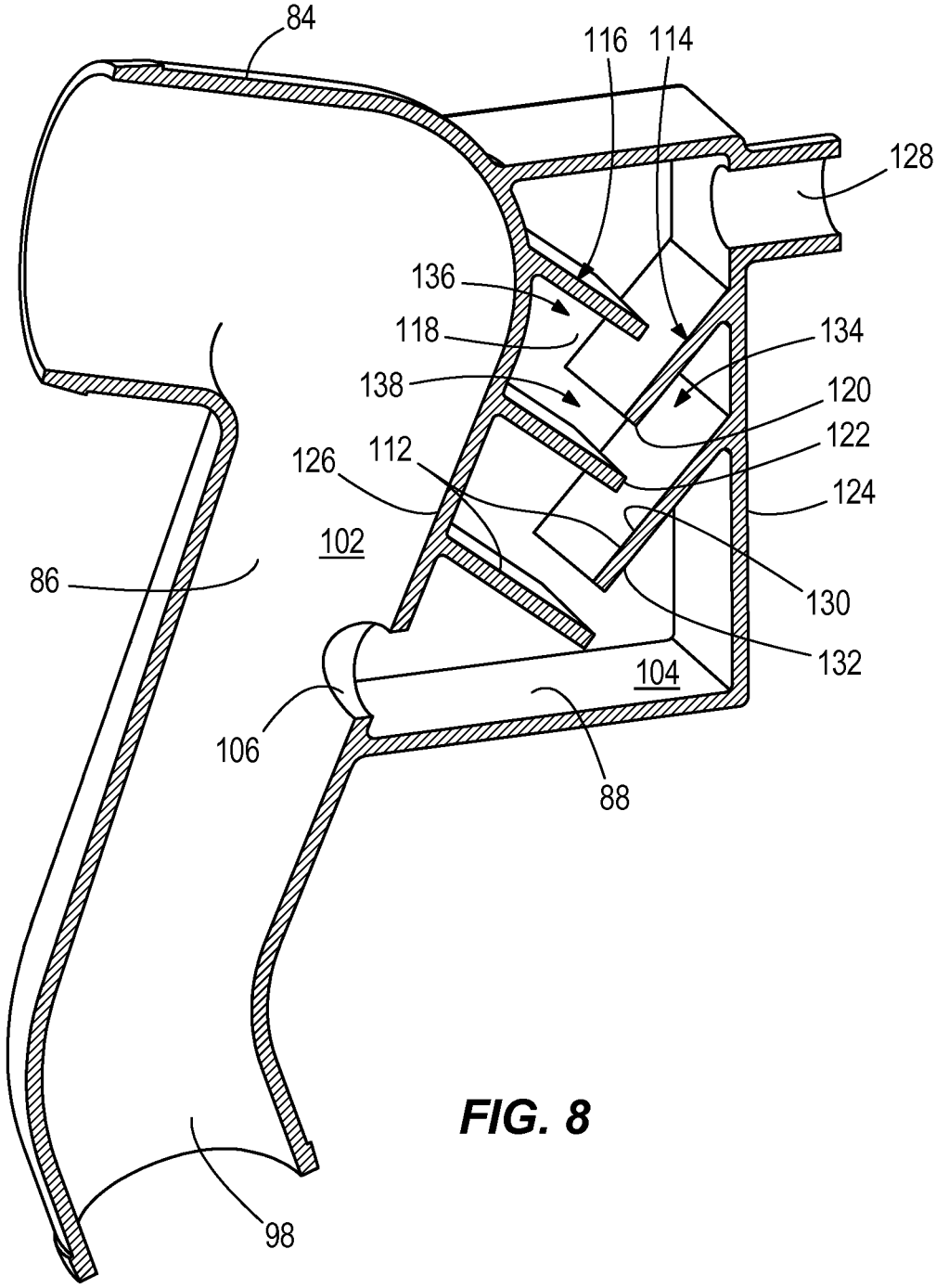

FIG. 8 is a sectional perspective view of a portion of the construction of FIG. 7.

DETAILED DESCRIPTION

Prior Art

Figure 1:
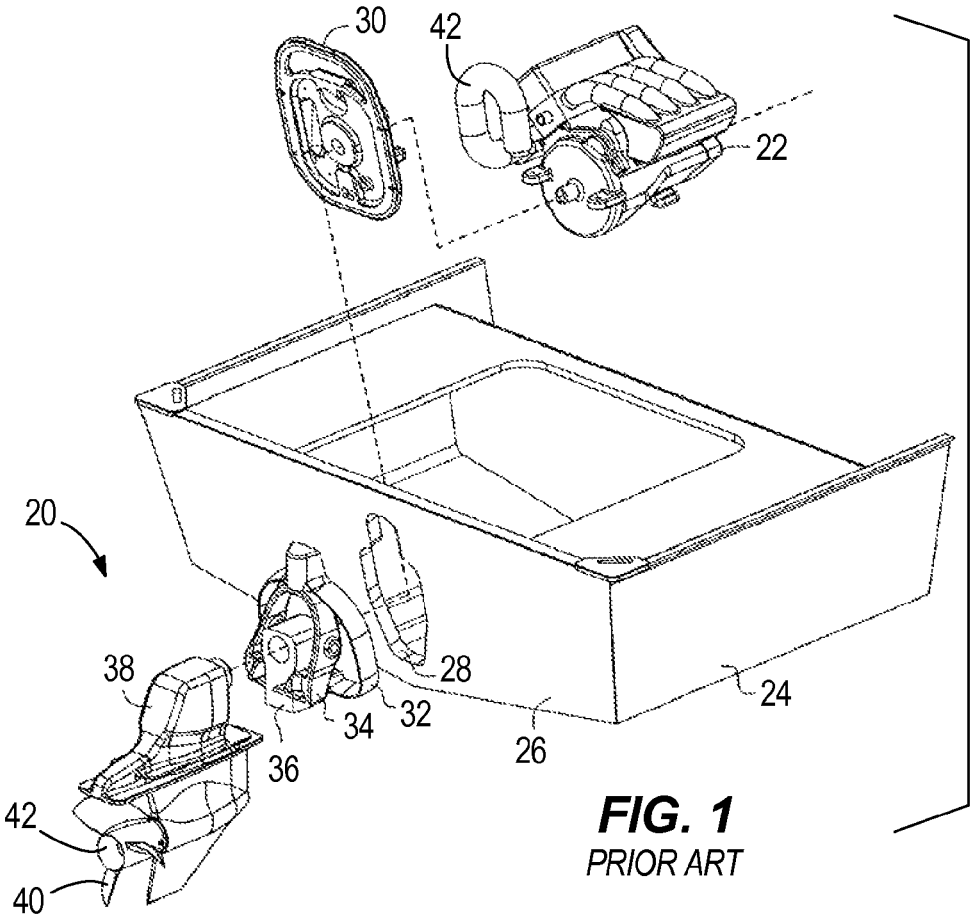
FIG. 1 PRIOR ART
FIG. 1 is taken from U.S. Pat. No. 7,354,324, incorporated herein by reference, and is an exploded isometric view of a marine propulsion system known in the prior art.

FIG. 1 shows a marine drive 20 including an inboard engine 22 for propelling a marine vessel 24 operating in a body of water. The vessel has a transom 26 with a hole or slot 28 for mounting the engine at transom bracket 30, transom ring 32, gimbal ring 34, and bell housing 36 to marine drive unit 38 for driving propeller 40, as is known. An exhaust system including exhaust conduit 42 discharges engine exhaust externally of the vessel, typically through transom hole 28 and gimbal ring 36 into drive unit 38 and downwardly and outwardly through submerged propeller hub 42, as is known. As an example, FIG. 1 shows a four cylinder in-line engine with a single bank of cylinders.

Figure 2:
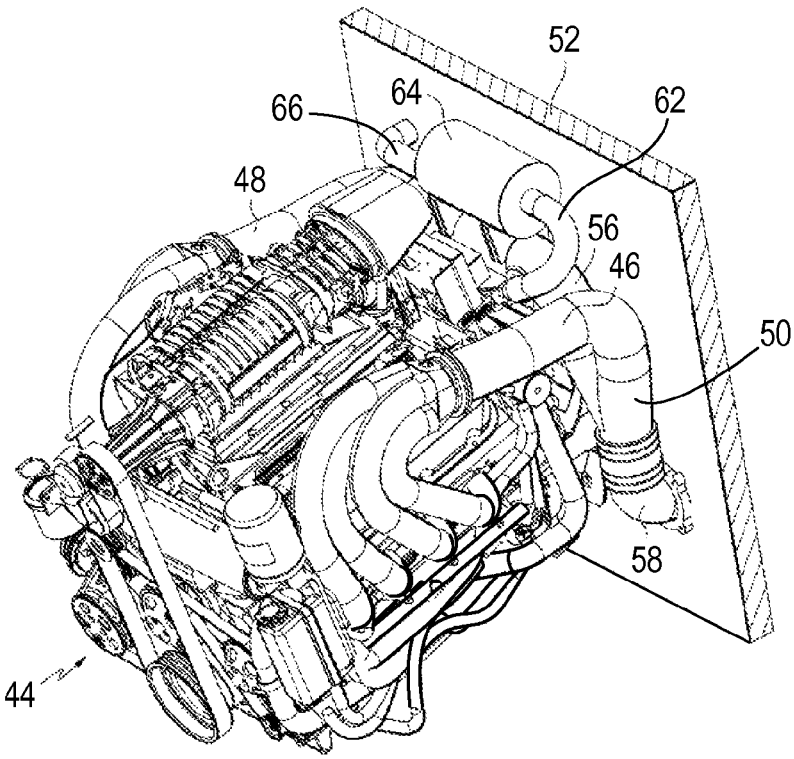
FIG. 2 PRIOR ART
FIG. 2 is taken from U.S. Patent Application Publication No. US2009/0269999, incorporated herein by reference, and is an isometric view of a portion of a marine propulsion system known in the prior art.
Figure 3:
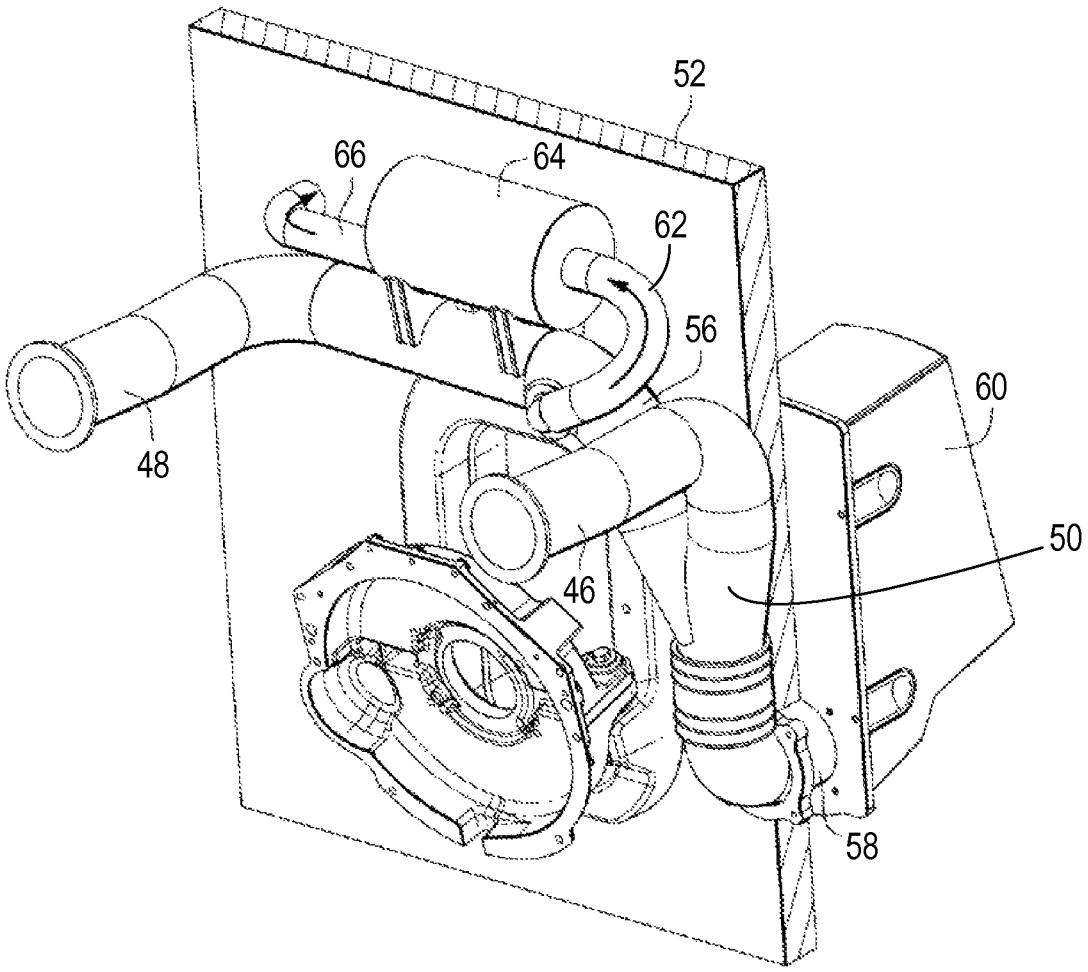
FIG. 3 PRIOR ART
FIG. 3 is taken from the noted '999 publication and further shows the idle relief system of FIG. 2.

FIGS. 2, 3 show a V-8 inboard engine 44 having port and starboard (left and right) banks of four cylinders each connected by respective port and starboard exhaust conduits 46 and 48 to exhaust pipe 50 for discharging the engine exhaust through transom 52 and externally of the vessel. Starboard exhaust conduit 48 has a cross over portion 56 joining port exhaust conduit 46 at exhaust pipe 50. The combined exhaust flows downwardly in exhaust pipe 50 then rearwardly at exhaust pipe 58 to external muffler 60, or alternatively or additionally to a drive unit such as 38 in FIG. 1. The exhaust system includes an auxiliary exhaust passage 62 through muffler 64 and exhaust pipe 66 through transom 52 to a shroud such as shown at 54 in FIG. 4 of the noted '999 publication.

Present Disclosure

FIGS. 4-8 illustrate the present disclosure, including a marine drive 70 including an inboard engine 72 having an exhaust system 74 discharging exhaust from the engine externally of a marine vessel operating in a body of water, as above. An exhaust conduit 76, and in the case of a dual bank, e.g. V-8, engine, a pair of exhaust conduits 76 and 78, receives the engine exhaust and discharges the exhaust externally of the vessel, as above, e.g. through a Y-shaped or bullhorn exhaust assembly 80 discharging the exhaust at 82 through the transom to the drive unit such as 38 above, e.g. for discharge through submerged propeller hub 42. Port exhaust conduit 76 includes an exhaust pipe 84 having a main exhaust flow chamber 86, FIGS. 7, 8, and an auxiliary idle relief chamber 88. The auxiliary idle relief chamber 88 vents exhaust above the surface of the body of water in which the vessel is operating, e.g. at vent tube 90 extending through transom 52. The engine may be a single bank in-line engine as in FIG. 1, and only a single exhaust pipe 86 and a single auxiliary idle relief chamber 88 may be used. Alternatively, in the case of a dual bank engine, e.g. a V-8 engine having port and starboard banks of four cylinders each, a second exhaust pipe 92 may be used having its own main exhaust flow chamber 94 and auxiliary idle relief chamber 96 and which may be the same as exhaust pipe 84, main exhaust flow chamber 86, and auxiliary idle relief chamber 88, respectively.

Most of the exhaust from main exhaust flow chamber 86, FIGS. 4-8, is discharged at outlet 98 of exhaust pipe 84 to flow through the left or port leg 100 of Y-shaped exhaust assembly or bullhorn 80 and then through outlet 82 to drive unit 38 to be discharged at submerged propeller hub 42 below the surface of the body of water in which the vessel is operating. In the embodiment shown, the exhaust flows downwardly in main exhaust flow chamber 86, and a small portion of the exhaust flows upwardly in auxiliary idle relief chamber 88, to be described, though other embodiments may include horizontal flow or near horizontal flow in one or both of the noted chambers. The exhaust flow through auxiliary idle relief chamber 88 provides a low back-pressure exhaust path for idle relief, where there is less exhaust pressure to force the exhaust through the submerged propeller hub.

Main exhaust flow chamber 86 has a downward extension section 102, FIGS. 7, 8, through which exhaust flows downwardly. The auxiliary idle relief chamber has an upward extension section 104 through which exhaust flows upwardly. Exhaust pipe 84 has transfer passage 106 extending laterally between downwardly extension section 102 and upward extension section 104. Most of the exhaust flows downwardly in downward extension section 102 past transfer passage 106 and continues to outlet 98 and is discharged, as above described, at a submerged location below the surface of the body of water in which the vessel is operating. A portion of the exhaust flows downwardly in downward extension section 102 and then laterally through transfer passage 106 into auxiliary idle relief chamber 88 and then upwardly in upward extension section 104.

As is known, cooling water is mixed with and entrained in the exhaust flowing through the exhaust pipe, e.g. at port and starboard exhaust elbows 108 and 110, FIGS. 4-6, in accordance with standard known practice. One or more deflection fins 112, FIGS. 7, 8, are provided in upward extension section 104 and separate entrained water from the exhaust flowing upwardly in auxiliary idle relief chamber 88. In one embodiment, the deflection fins include a plurality of fins in an open gap zig-zag pattern including a first set of fins 114 extending in a first direction (e.g. downwardly and leftwardly in the orientation of FIGS. 7, 8), and a second set of fins 116 extending in a second direction (e.g. downwardly and rightwardly in the orientation of FIGS. 7, 8) and facing the first set of fins across open gaps such as 118 therebetween through which the exhaust flows. In the embodiment shown, the deflection fins extend diagonally downwardly to lower termination tips such as 120, 122 discharging separated water after flowing downwardly diagonally along the respective deflection fins. Auxiliary idle relief chamber 88 has laterally distally opposite walls, e.g. right and left walls 124 and 126 respectively, in the orientation of FIGS. 7, 8, defining the noted upward extension section 104 laterally therebetween. The deflection fins include the noted first set of fins 114 extending downwardly and laterally leftwardly from right wall 124, and the noted second set of fins 116 extending downwardly and laterally rightwardly from left wall 126, in the orientation of FIGS. 7, 8. The termination tip such as 120 of at least a designated one of the right set of fins 114 is laterally spaced leftwardly of the termination tip such as 122 of at least a designated one of the left set of fins 116. The termination tip such as 120 of at least a selected one of the right set of fins 114 is vertically spaced from the termination tip such as 122 of at least a selected one of the left set of fins 116.

Auxiliary idle relief chamber 88 has an upper outlet port 128, FIGS. 4-8. The deflection fins define a tortuous non-rectilinear flow path from transfer passage 106 upwardly to outlet port 128. The deflection fins include the noted first and second sets of fins 114 and 116 each having an upper surface 130 and a lower surface 132, FIGS. 7, 8. The lower surfaces such as 132 of the first and second sets of fins 114 and 116 are impaction surfaces separating entrained water from the exhaust. The upper surfaces such as 130 of the first set of fins 114 are guide surfaces directing the exhaust toward outlet port 128. The upper surfaces of the second set of fins 116 are guide surfaces directing the exhaust away from outlet port 128.

Exhaust pipe 84, including main exhaust flow chamber 86 and auxiliary idle relief chamber 88, is in one embodiment a single casting, providing the above-noted idle relief system with an integrated sound attenuation chamber, to be described. The incorporation of a sound muffling device directly with the exhaust pipe, without the use of an ancillary muffler, reduces cost and complexity.

The one or more deflection fins in the auxiliary idle relief chamber separate entrained water from the exhaust flowing in the auxiliary idle relief chamber. The deflection fins extend non-parallel to the direction of exhaust flow through the auxiliary idle relief chamber. The deflection fins extend to termination tips discharging separated water after flowing along the deflection fins. The first and second sets of deflection fins extend from distally opposite walls of the auxiliary idle relief chamber to respective first and second sets of termination tips. The first and second sets of deflection fins extend from distally opposite walls of the auxiliary idle relief chamber in overlapping relation to overlapped first and second sets of termination tips to define a tortuous non-rectilinear exhaust flow path traversing in a zig-zag pattern through the auxiliary idle relief chamber. The deflection fins of the first set 114 are spaced from each other by open slots such as 134, FIGS. 7, 8, providing a first set of noise-reducing expansion chambers communicating with the exhaust flow path through the auxiliary idle relief chamber. The deflection fins of the second set 116 are spaced from each other by open slots such as 136 providing a second set of noise-reducing expansion chambers communicating with the exhaust flow path through the auxiliary idle relief chamber and with the first set of noise-reducing expansion chambers 134. The first and second sets of noise-reducing expansion chambers 134 and 136 have overlapped common sections such as 138 at the noted tortuous non-rectilinear exhaust flow path through auxiliary idle relief chamber 88.

Auxiliary idle relief chamber 88, first and second sets of fins 114 and 116, and first and second sets of noise-reducing expansion chambers 134 and 136 are sized with sufficient volume to provide adequate sound attenuation, as determined by the particular engine used. In the case of a second bank of cylinders, the second exhaust pipe 92 and second auxiliary idle relief chamber 96 are comparably configured to exhaust pipe 84 and auxiliary idle relief chamber 88, respectively.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A marine drive comprising an inboard engine having an exhaust system discharging exhaust from said engine externally of a marine vessel operating in a body of water, an exhaust conduit receiving said exhaust and discharging said exhaust externally of said vessel, said exhaust conduit comprising an exhaust pipe having a main exhaust flow chamber and an auxiliary idle relief chamber, said main exhaust flow chamber and said auxiliary idle relief chamber located within a hull of the marine vessel, said auxiliary idle relief chamber venting exhaust above the surface of said body of water;

wherein said exhaust from said main exhaust flow chamber is discharged below said surface of said body of water; said exhaust flows downwardly in said main exhaust flow chamber; and said exhaust flows upwardly in said auxiliary idle relief chamber; and wherein said main exhaust flow chamber has a downward extension section through which said exhaust flows downwardly, said auxiliary relief chamber has an upward extension section through which said exhaust flows upwardly, said exhaust pipe has a transfer passage extending laterally between said downward extension section and a lower portion of said upward extension section, such that said exhaust flows downwardly in said downward extension section passed said transfer passage and is discharged at a submerged location below said surface of said body of water, and such that a portion of said exhaust that is flowing downwardly in said downward extension section separates from said exhaust by flowing laterally through said transfer passage into said auxiliary idle relief chamber and then upwardly in said upward extension section.

2. The marine drive according to claim 1 wherein cooling water is mixed with and entrained in said exhaust flowing through said exhaust pipe, and comprising one or more deflection fins in said upward extension section separating entrained water from said exhaust flowing upwardly in said auxiliary idle relief chamber.

3. The marine drive according to claim 2 wherein said deflection fins comprise a plurality of fins in an open gap zig-zag pattern comprising a first set of fins extending in a first direction, and a second set of fins extending in a second direction and facing said first set of fins across open gaps therebetween through which said exhaust flows.

4. The marine drive according to claim 2 wherein said deflection fins extending diagonally downwardly to lower termination tips discharging separated water after flowing downwardly diagonally along said deflection fins.

5. The marine drive according to claim 2 wherein said auxiliary idle relief chamber has an upper outlet port, and wherein said deflection fins define a tortuous non-rectilinear flow path from said transfer passage upwardly to said outlet port.

6. A marine drive comprising an inboard engine having an exhaust system discharging exhaust from said engine externally of a marine vessel operating in a body of water, an exhaust conduit receiving said exhaust and discharging said exhaust externally of said vessel, said exhaust conduit comprising an exhaust pipe having a main exhaust flow chamber and an auxiliary idle relief chamber, said auxiliary idle relief chamber venting exhaust above the surface of said body of water;

wherein said exhaust from said main exhaust flow chamber is discharged below said surface of said body of water; said exhaust flows downwardly in said main exhaust flow chamber; and said exhaust flows upwardly in said auxiliary idle relief chamber;

wherein said main exhaust flow chamber has a downward extension section through which said exhaust flows downwardly, said auxiliary relief chamber has an upward extension section through which said exhaust flows upwardly, said exhaust pine has a transfer passage extending laterally between said downward extension section and a lower portion of said upward extension section, such that said exhaust flows downwardly in said downward extension section passed said transfer passage and is discharged at a submerged location below said surface of said body of water, and such that a portion of said exhaust flows downwardly in said downward extension section and then laterally through said transfer passage into said auxiliary idle relief chamber and then upwardly in said upward extension section;

wherein cooling water is mixed with and entrained in said exhaust flowing through said exhaust pipe, and comprising one or more deflection fins in said upward extension section separating entrained water from said exhaust flowing upwardly in said auxiliary idle relief chamber; and wherein said auxiliary idle relief chamber has laterally distally opposite right and left walls defining said upward extension section laterally therebetween, said deflection fins comprise a first set of fins extending downwardly and laterally leftwardly from said right wall, and a second set of fins extending downwardly and laterally rightwardly from said left wall.

7. A marine drive comprising an inboard engine having an exhaust system discharging exhaust from said engine externally of a marine vessel operating in a body of water, an exhaust conduit receiving said exhaust and discharging said exhaust externally of said vessel, said exhaust conduit comprising an exhaust pipe having a main exhaust flow chamber and an auxiliary idle relief chamber, said auxiliary idle relief chamber venting exhaust above the surface of said body of water;

wherein said exhaust from said main exhaust flow chamber is discharged below said surface of said body of water; said exhaust flows downwardly in said main exhaust flow chamber; and said exhaust flows upwardly in said auxiliary idle relief chamber;

wherein said main exhaust flow chamber has a downward extension section through which said exhaust flows downwardly, said auxiliary relief chamber has an upward extension section through which said exhaust flows upwardly, said exhaust pipe has a transfer passage extending laterally between said downward extension section and a lower portion of said upward extension section, such that said exhaust flows downwardly in said downward extension section passed said transfer passage and is discharged at a submerged location below said surface of said body of water, and such that a portion of said exhaust flows downwardly in said downward extension section and then laterally through said transfer passage into said auxiliary idle relief chamber and then upwardly in said upward extension section;

wherein cooling water is mixed with and entrained in said exhaust flowing through said exhaust pipe, and comprising one or more deflection fins in said upward extension section separating entrained water from said exhaust flowing upwardly in said auxiliary idle relief chamber;

wherein said auxiliary idle relief chamber has laterally distally opposite right and left walls defining said upward extension section laterally therebetween, said deflection fins comprise a first set of fins extending downwardly and laterally leftwardly from said right wall, and a second set of fins extending downwardly and laterally rightwardly from said left wall; and wherein said deflection fins extend to lower termination tips discharging separated water therefrom, the termination tips of at least a designated one of said first set of fins being laterally spaced leftwardly of the termination tip of at least a designated one of said second set of fins.

8. The marine drive according to claim 7 wherein the termination tip of at least a selected one of said first set of fins is vertically spaced from the termination tip of at least a selected one of said second set of fins.

9. A marine drive comprising an inboard engine having an exhaust system discharging exhaust from said engine externally of a marine vessel operating in a body of water, an exhaust conduit receiving said exhaust and discharging said exhaust externally of said vessel, said exhaust conduit comprising an exhaust pipe having a main exhaust flow chamber and an auxiliary idle relief chamber, said auxiliary idle relief chamber venting exhaust above the surface of said body of water;

wherein said exhaust from said main exhaust flow chamber is discharged below said surface of said body of water; said exhaust flows downwardly in said main exhaust flow chamber; and said exhaust flows upwardly in said auxiliary idle relief chamber;

wherein said main exhaust flow chamber has a downward extension section through which said exhaust flows downwardly, said auxiliary relief chamber has an upward extension section through which said exhaust flows upwardly, said exhaust pipe has a transfer passage extending laterally between said downward extension section and a lower portion of said upward extension section, such that said exhaust flows downwardly in said downward extension section passed said transfer passage and is discharged at a submerged location below said surface of said body of water, and such that a portion of said exhaust flows downwardly in said downward extension section and then laterally through said transfer passage into said auxiliary idle relief chamber and then upwardly in said upward extension section;

wherein cooling water is mixed with and entrained in said exhaust flowing through said exhaust pipe, and comprising one or more deflection fins in said upward extension section separating entrained water from said exhaust flowing upwardly in said auxiliary idle relief chamber;

wherein said auxiliary idle relief chamber has an upper outlet port, and wherein said deflection fins define a tortuous non-rectilinear flow path from said transfer passage upwardly to said outlet port; and wherein said deflection fins comprise first and second sets of fins each having an upper surface and lower surface, the lower surfaces of said first and second sets of fins being impaction surfaces separating entrained water from said exhaust, the upper surfaces of said first set of fins being guide surfaces directing said exhaust toward said outlet port, the upper surfaces of said second set of fins being guide surfaces directing said exhaust away from said outlet port.

10. A marine exhaust pipe for a marine drive having an inboard engine having an exhaust system discharging exhaust from said engine externally of a marine vessel operating in a body of water, and an exhaust conduit receiving said exhaust and discharging said exhaust externally of said vessel, said marine exhaust pipe comprising a main exhaust flow chamber and an auxiliary idle relief chamber, said auxiliary idle relief chamber venting said exhaust above the surface of said body of water;

wherein cooling water is mixed with and entrained in said exhaust flowing through said exhaust pipe, and comprising one or more deflection fins in said auxiliary idle relief chamber separating entrained water from said exhaust flowing in said auxiliary idle relief chamber;

wherein said deflection fins extend non-parallel to the direction of exhaust flow through said auxiliary idle relief chamber, said deflection fins extending to termination tips discharging separated water after flowing along said deflection fins; and comprising first and second sets of deflection fins extending from distally opposite walls of said auxiliary idle relief chamber to respective first and second sets of termination tips;

wherein said first and second sets of deflection fins extend from said distally opposite walls of said auxiliary idle relief chamber in overlapping relation to overlapped said first and second sets of termination tips to define a tortuous non-rectilinear exhaust flow path traversing in a zig-zag pattern through said auxiliary idle relief chamber; and wherein said deflection fins of said first set are spaced from each other by open slots providing a first set of noise-reducing expansions chambers communicating with the exhaust flow path through said auxiliary idle relief chamber, and wherein said deflection fins of said second set are spaced from each other by open slots providing a second set of noise-reducing expansion chambers communicating with the exhaust flow path through said auxiliary idle relief chamber.

11. The marine exhaust pipe according to claim 10 wherein said marine exhaust pipe, including said main exhaust flow chamber and said auxiliary idle relief chamber, is a single casting.

12. The marine exhaust pipe according to claim 10 wherein said deflection fins comprise a plurality of fins in an open gap zig-zag pattern comprising a first set of fins extending in a first direction, and a second set of fins extending in a second direction and facing said first set of fins across open gaps therebetween through which said exhaust flows.

13. The marine exhaust pipe according to claim 10 wherein said first and second sets of deflection fins extend from said distally opposite walls of said auxiliary idle relief chamber in overlapping relation to overlapped said first and second sets of termination tips to define a tortuous non-rectilinear exhaust flow path traversing in a zig-zag pattern through said auxiliary idle relief chamber, and wherein said first and second sets of expansions chambers have overlapped common sections at said tortuous non-rectilinear exhaust flow path through said auxiliary idle relief chamber.

* * * * *

UNITED STATES PATENT AND TRADEMARK OFFICE

CERTIFICATE OF CORRECTION

PATENT NO. : 8,876,566 B1
APPLICATION NO. : 13/678165
DATED : November 4, 2014
INVENTOR(S) : David J. Hilbert et al.

It is certified that error appears in the above-identified patent and that said Letters Patent is hereby corrected as shown below:

On the Title page of the patent, at item (71), in the second line, "WI" should instead read --IL--.

In The Claims

In Claim 6, Column 5, Line 35: "pine" should instead read --pipe--.

Signed and Sealed this
Twelfth Day of May, 2015

Michelle K. Lee

Michelle K. Lee
*Director of the United States Patent and Trademark Office*